US006438921B1

(12) United States Patent
Moore

(10) Patent No.: US 6,438,921 B1
(45) Date of Patent: Aug. 27, 2002

(54) COMBINATION HANGING CLIP AND T-BAR CONNECTOR

(75) Inventor: Ronald C. Moore, Bowie, MD (US)

(73) Assignee: Pittcon Industries

( * ) Notice: Subject to any disclaimer, the term of this patent is extended or adjusted under 35 U.S.C. 154(b) by 0 days.

(21) Appl. No.: 09/696,684

(22) Filed: Oct. 26, 2000

Related U.S. Application Data

(60) Provisional application No. 60/161,353, filed on Oct. 26, 1999.

(51) Int. Cl.[7] ..... E04B 5/52

(52) U.S. Cl. ..... 52/655.1; 52/506.07; 52/506.08; 52/665; 52/714

(58) Field of Search ..... 52/714, 665, 655.1, 52/489.1, 506.07, 506.08, 506.06; 403/252, 258, 259, 286

(56) References Cited

U.S. PATENT DOCUMENTS

| | | | |
|---|---|---|---|
| 1,096,806 | A | 5/1914 | Herbert |
| 3,798,865 | A | 3/1974 | Curtis |
| 3,918,234 | A | 11/1975 | Weissman |
| 4,479,341 | A | 10/1984 | Schuplin |
| 4,641,987 | A | 2/1987 | Schlegel |
| 4,715,161 | A | 12/1987 | Carraro et al. |
| 4,723,749 | A | 2/1988 | Carraro et al. |
| 4,991,373 | A | 2/1991 | Shaub |
| 5,154,031 | A | 10/1992 | Wall |
| 5,195,286 | A | 3/1993 | DeLong et al. |
| 5,355,646 | A | 10/1994 | Bischel et al. |
| 5,355,648 | A | 10/1994 | Graver et al. |
| 5,557,902 | A | 9/1996 | Witmyer |
| 5,572,844 | A | 11/1996 | Stackenwalt et al. |
| 5,937,605 | A | 8/1999 | Wendt |

*Primary Examiner*—Carl D. Friedman
*Assistant Examiner*—Jennifer I. Thissell
(74) *Attorney, Agent, or Firm*—Patton Boggs LLP

(57) ABSTRACT

The suspended ceiling frame having a combination clip for connecting a first perimeter member to a suspended frame and for a connecting a second perimeter member to the suspended frame. In a first orientation a first tang of the combination clip locks between upper and lower grooves of the first perimeter member and an extension of the combination clip attaches to the suspended frame. In a second orientation the first tang is locked between the upper and lower grooves of the second perimeter member, while a second tang of the combination clip is attached to the suspended frame.

6 Claims, 4 Drawing Sheets

COMBINATION HANGING CLIP AND T-BAR CONNECTOR

This application claims priority from provisional application No. 60/161,353, filed Oct. 26, 1999.

FIELD OF THE INVENTION

The present invention generally relates to suspended ceiling and lighting fixtures and, more particularly, to a combination clip which when rotated into a first orientation functions to secure a first ceiling fixture to a second ceiling fixture and, when rotated into a second orientation, functions to secure the second ceiling fixture to a third ceiling fixture.

BACKGROUND OF THE INVENTION

Suspended ceilings are known in the art of commercial and residential construction, as are a variety of apparatuses for securing the fixtures of the suspended ceilings to structural members of the ceiling and walls of an interior room.

One type of known apparatus and hardware for securing suspended ceilings and fixtures is depicted by prior art FIG. 1. The prior art FIG. 1 hardware employs a first T-grid frame 2 which is suspended by a plurality of wires 4 from the structure of the ceiling of a room (not shown). The first T-grid frame 2 functions, in part, to support a first plurality of ceiling panels (not shown). A second T-grid frame 6 is suspended by a plurality of wires 8 from the first T-grid frame 2. A common configuration of the second T-grid 6 is a rectangular shape lying within a plane parallel to, but lower than, the plane of the first T-grid frame 2, having a length and width smaller than that of the overall ceiling of the room and of the first T-grid frame. Prior art FIG. 1 also depicts, in cross-sectional view, one perimeter of its second T-grid frame 6 in relation to its first T-grid frame 2. This is only an example configuration of the first and second T-grid frames 2 and 6, as others are known in the art.

Referring to the example Prior Art FIG. 1, a first perimeter trim 10 extends along the upper surface of the second T-grid frame 6, inward from and along the perimeter 12 of the frame, and up to a connection point 14 on the lower surface of the first T-grid frame. One or more light fixtures 16 are generally mounted on the upper plane of the second T-grid frame. The light fixture 16 and the first perimeter trim 10 are secured to a one more connection points 18 of the second T-grid frame 6 by a first hanging clip 20. The first hanging clip 20 has tongue surfaces 20*a* and 20*b* which engage into grooves 10*a* and 10*b* of the first perimeter trim 10. Prior art FIG. 2 depicts the first hanging clip 20 in greater detail. Referring back to Prior Art FIG. 1, at the extreme perimeter 12 of the second T-grid frame is a second perimeter trim 22, secured to the frame by a second hanging clip 24. Prior Art FIG. 3 depicts the second hanging clip 24 in greater detail.

A complete suspended ceiling of the type depicted by the prior art FIG. 1 typically uses a large quantity of the first hanging clips 20 and an approximately equal quantity of the second hanging clips 24. The contractor must therefore stock both types of hanging clips. In addition, a contractor typically over-orders because the relative number of one type versus the other is not always known until the time of installation. Further, an order for the hanging clips 20 and 24 must separately specify the two types and respective numbers of each. This in turn doubles the error rate arising from mistakes, both in part numbers and quantities ordered. Having to carry two part numbers also increases the stocking costs for the wholesalers. For these and other reasons the requirement to stock two different kinds of hanging clips is inefficient and carries unnecessary expense.

SUMMARY OF THE INVENTION

An objective of the present invention is to provide a solution to the prior art problems of stocking, purchasing, and installing two different types of hanging clips to install a hanging ceiling arrangement such as that depicted at prior art FIG. 1.

One embodiment of the present invention comprises a first and a second T-grid frame, a first and a second perimeter trim, such as used, for example, in the prior art, and two or more identical combination clips. In accordance with this embodiment, all of the combination clips are identical. Therefore, instead of different clip types for different functions, as are used within the hardware of hanging s of the prior art, there is one clip type, termed herein as the "combination clip." As described herein, the structure and form of the combination clip of this embodiment is such that in one orientation the clip serves the function of the prior art first clip type, while in another orientation the clip performs the function of the prior art second clip type.

In a typical arrangement of this embodiment, a first perimeter trim is connected to the first T-grid frame and the second T-grid frame, such as that described in reference to Prior Art FIG. 1. The first perimeter trim comprises an extended planar member having a face surface, an upper and lower groove and extending along one surface of the face surface, and an upper and a lower edge tang. The upper edge tang of the first perimeter trim is connected to the first T-grid frame. One or more of the combination clips, oriented in a first manner, serves the function of item 20 of Prior Art FIG. 1, which is to connect the first perimeter trim to the second T-grid frame. Another one or more of the combination clips, oriented in a second manner, serve the function of the second type of clip, shown as item 22 in Prior Art FIG. 1, which is to connect an end portion of the second T-grid frame to a portion of the second perimeter trim.

The combination clip of this embodiment comprises a first tang extending in a first plane, and a second tang extending in a second plane perpendicular to the first plane. The first and second tang join at a corner line formed by the intersection of the first and second plane. The first tang has a major length in the direction of the corner line, the major length corresponding to the distance between the upper and lower grooves of the perimeter trim. The first tang has a width, which is perpendicular to the corner line, and is less than the major length. One of the corners of the first tang that is distal from the corner line is beveled or rounded. The beveled or rounded corner, together with the major length and the width of the first tang, are dimensioned and formed such that first tang can be placed in a first orientation wherein the first tang width extends between the upper and lower grooves of the perimeter trim. Then, after placing the first tang in the first orientation, it is rotated such that the major length extends between the upper and lower grooves. This locks the first tang between the upper and lower grooves.

The first tang of the first embodiment may also include a first threaded through hole, extending normal to the first plane. A first screw may then be threaded through the first threaded hole to contact the perimeter trim, thereby further securing the first tang in its locked position between the upper and lower grooves of the perimeter trim.

The combination clip of the first embodiment further comprises a second tang extending from the corner line in the second plane, which is perpendicular to the first plane. The first and second tang thereby form a substantially L-shaped structure. The second tang of this embodiment has at least one through hole for attaching the second tang to a "T" grid The second tang of the first embodiment further includes an extension projecting in a direction substantially parallel to the corner line, the extension having a distal end, with a through-hole formed at the distal end. As will be described, a second screw may pass through the through-hole of the second tang and engage with a threaded hole formed in the second T-grid frame.

The combination clips of this embodiment, as a result of their novel structure, serve both to connect the first perimeter trim to the second T-grid frame, and to connect an end portion of the second T-grid frame to a portion of the second perimeter trim. More particularly, one or more of the combination clips is in a first orientation, in which the first tang is locked between the upper and lower grooves of the first perimeter trim and the extension of the second tang is secured to the second "T" grid frame. The securing may be attained by a screw passing through the through-hole in the distal end of the extension and threaded into the second "T" grid frame. Another one or more of the combination clips is oriented in a second manner, in which the first tang is locked between the upper and lower grooves of the second perimeter trim, while the second tang is attached to the second "T" grid frame. Because of the L-shaped configuration between the first and second tangs, the second "T" grid frame is substantially aligned between the upper and lower grooves in which the first tang is locked.

Accordingly, the single combination clip of the present invention, by being rotated into different orientations, and by utilizing respective sub-portions of its tangs, accomplishes either of the two different connection functions which the prior art required a respective two different types of clips to accomplish.

BRIEF DESCRIPTION OF THE DRAWINGS

These features and advantages of the present invention will be more fully disclosed in, or rendered obvious by, the following detailed description of the preferred embodiment of the invention, which is to be considered together with the accompanying drawings wherein like numbers refer to like parts and further wherein.

DETAILED DESCRIPTION OF THE PREFERRED EMBODIMENTS

The apparatus and method of the present invention will be better understood by the following description in reference to the attached figures.

Figure 1:
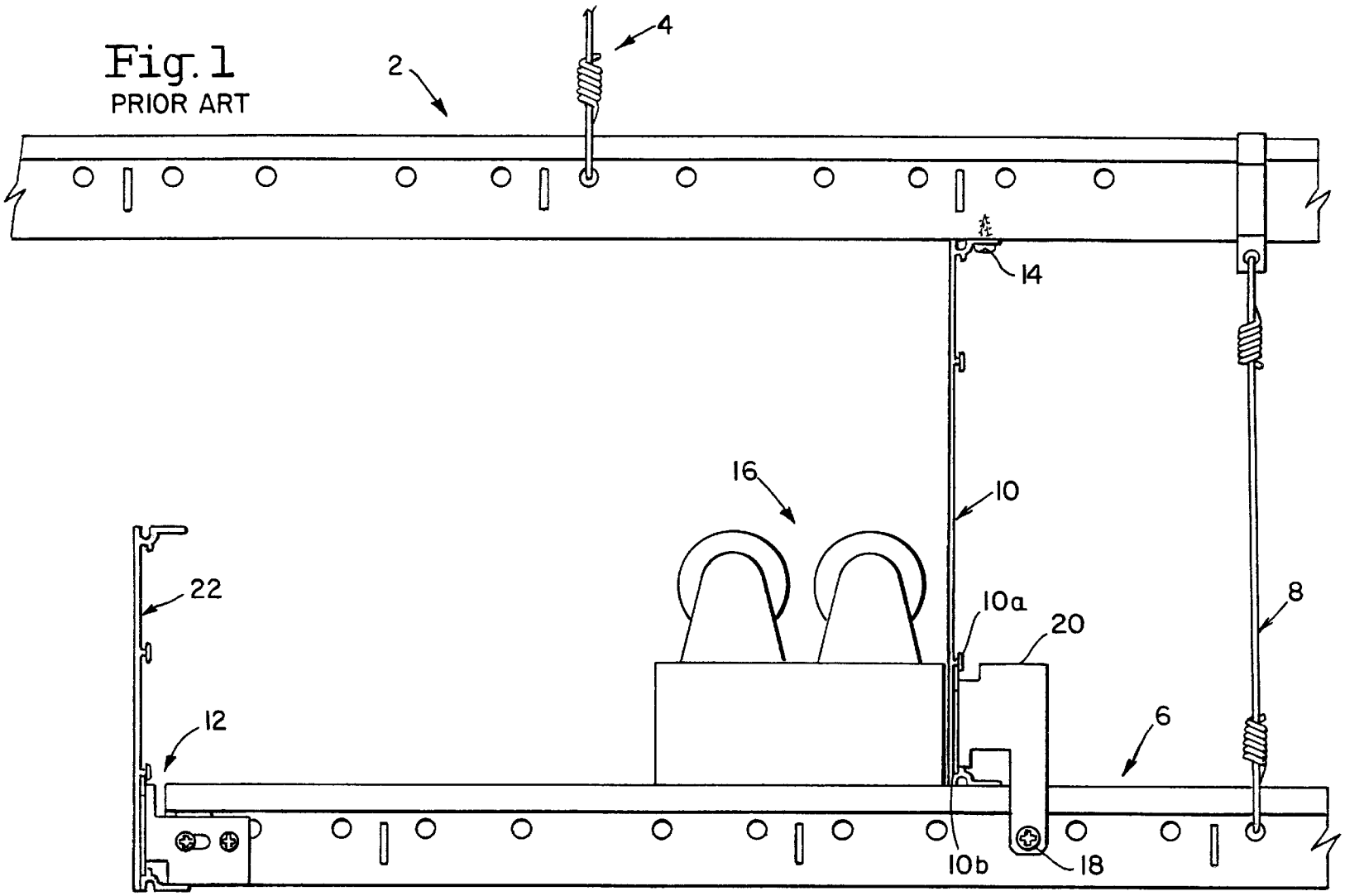
Fig. 1 PRIOR ART
FIG. 1 shows a prior art suspended ceiling and structure.
Figure 3:
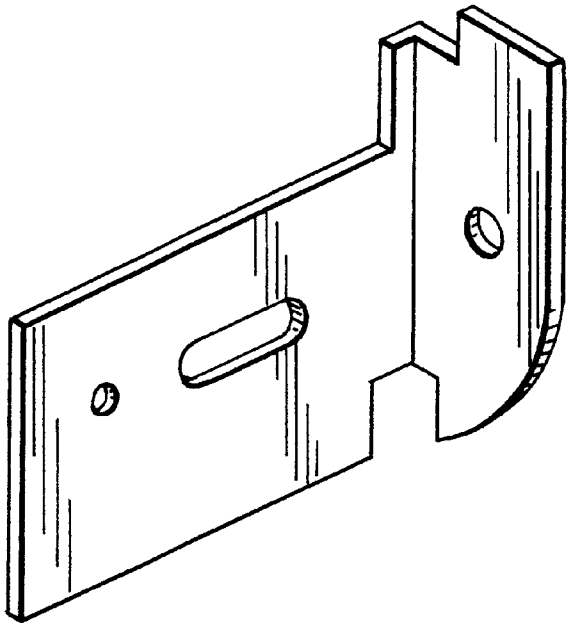
Fig. 3 PRIOR ART
FIG. 3 shows a second of the two types of hanging clips employed within the prior art suspended ceiling of FIG. 1.
Figure 2:
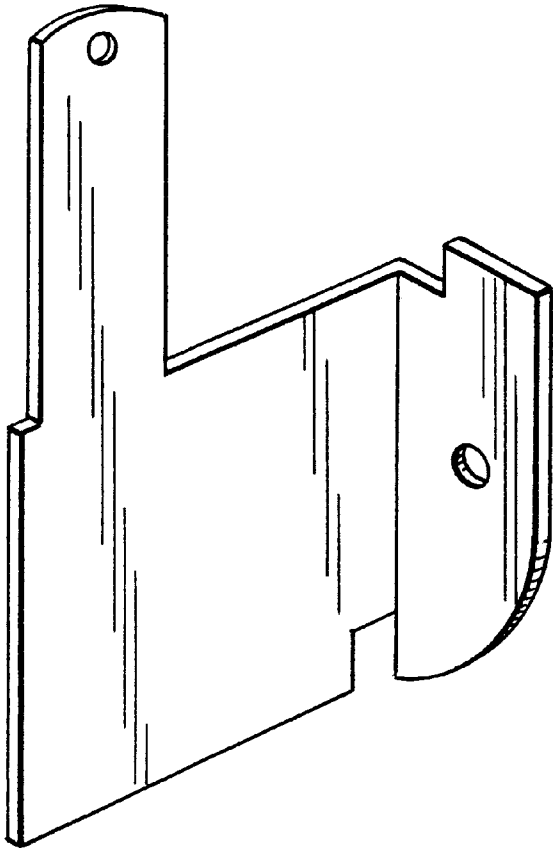
Fig. 2 PRIOR ART
FIG. 2 shows a first of the two types of hanging clips employed within the prior art suspended ceiling of FIG. 1.
Figure 4:
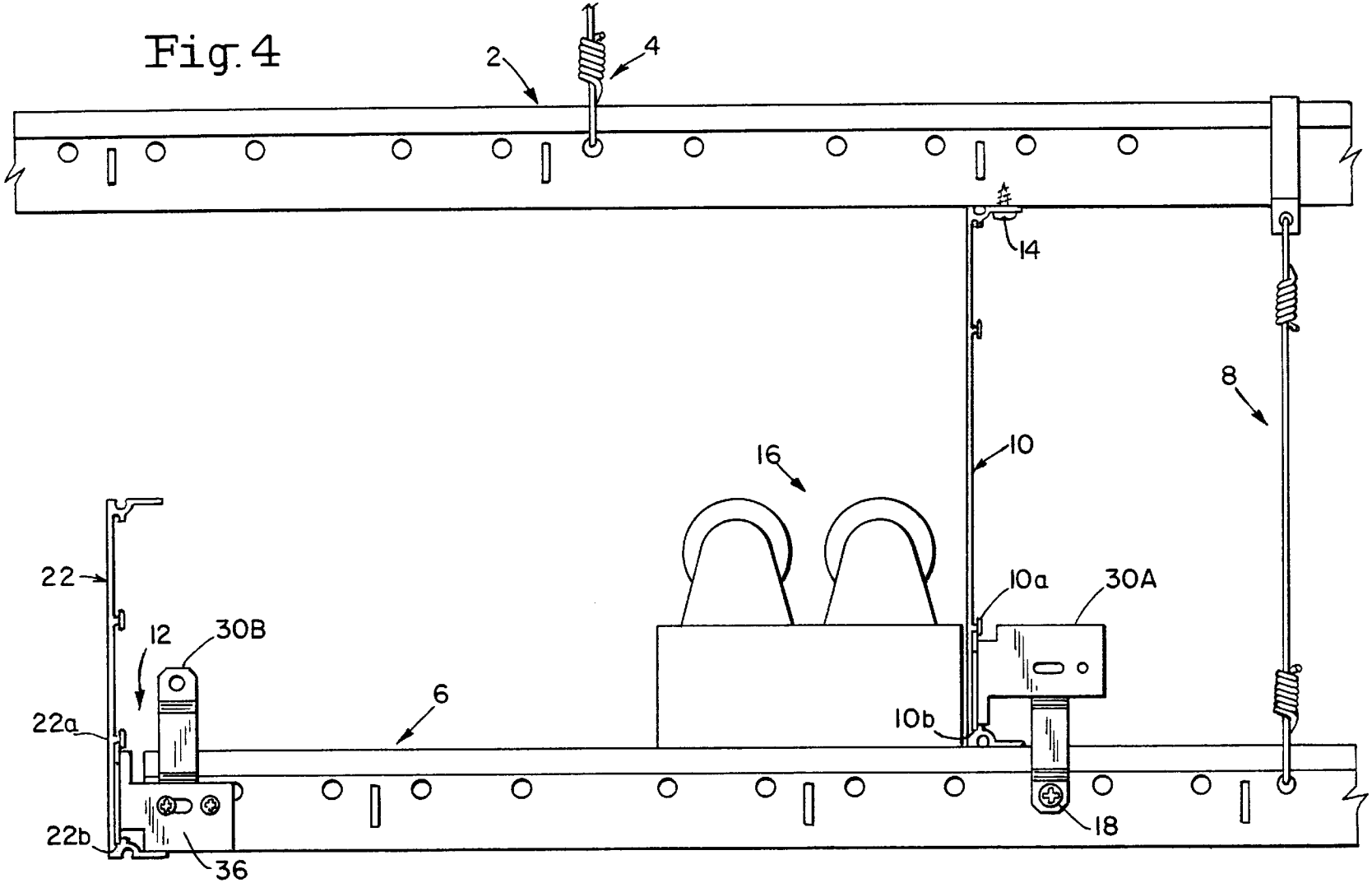
FIG. 4 shows a perimeter portion of an example suspended ceiling and arrangement according to an embodiment of the present invention.

FIGS. 4 and 5A–5C depict an example embodiment of the apparatus of the present invention. Referring to FIG. 4, the example embodiment comprises a combination of the first and second T-grid frames 2 and 6, and the first and second perimeter trims 10 and 22 of prior art FIG. 1. As known to one of skill in the art, the first and second T-grid frames and first and second perimeter trims are substantially more extensive in size and number than the portions depicted in FIG. 4, but the portions depicted are representative of the kinds of interconnects that relate to the present invention.

As shown in FIG. 4, the first perimeter trim 10 is connected to the second T-grid frame by a first combination clip 30*a*. The second perimeter trim 22 is connected to the second T-grid frame by a second combination clip 30*b*. The first and second combination clips 30A and 30B have identical structure and form, which permits the exact same kind of clip to serve, in one orientation, as the 30A clip and, in another orientation, as the 30*b* clip.

Figure 5C:
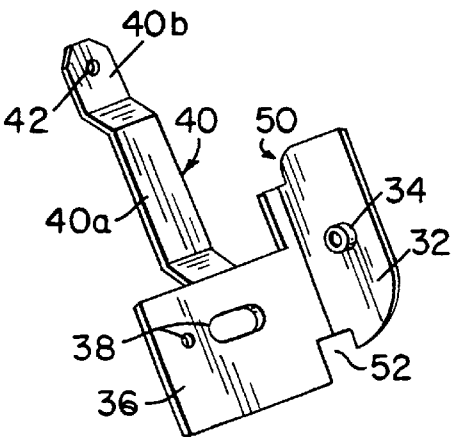
FIGS. 5A, 5B and 5C shows a front view, a side view and a perspective view, respectively, of an example embodiment of a combination hanging clip according to the present invention.
Figure 5B:
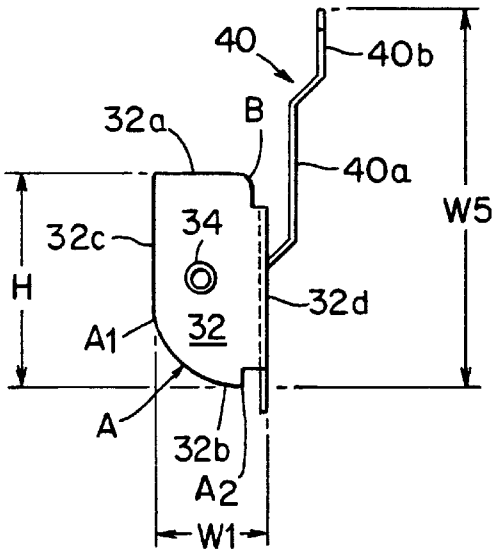
Figure 5A:
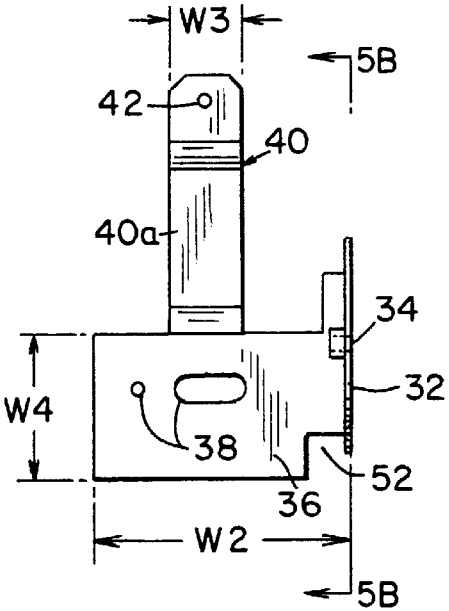

FIGS. 5A–5C show a detailed construction of the first and second combination clips 30A and 30B, which are referenced collectively as 30.

Referring to FIGS. 5A–5C, the combination clip 30 comprises a first tang 32 extending in a first plane, the first tang having an upper edge 32*a* and a lower edge 32*b*, spaced apart by a major height H. Referring to FIG. 4, the upper edge 32*a* and lower edge 32*b* are engaged to the upper and lower grooves 10*a* and 10*b*, respectively, of the first perimeter trim 10. The major height H corresponds to the spacing between the upper and lower groove 10*a* and 10*b*, and the same spacing between the upper and lower groove 22*a* and 22*b*, of the first and second perimeter trim 10 and 22, respectively. As shown in Table 1 below, the major height H for one particular example according to FIG. 5 is 1.5", although other sizes are set to correspond to different perimeter trims. Referring to FIGS. 5A–5C, a proximal edge 32*c* and a distal edge 32*d* are spaced apart by a width W1. The lower edge 32*b* is formed as a first arc A, extending from a point Al on left edge 32*c* to a point A2 proximal to the right edge 32*d*. The arc A, the major height H and the width W1 are selected to permit the first tang 32 to be placed against the first perimeter trim, between the groove pairs 10*a* and lob, or 22*a* and 22*b*, in a first orientation wherein the left edge 32*c* and right edge 32*d* are parallel to the groove pairs, and then rotated such that the height H extends between and locks under the groove pairs. As can be seen by one of ordinary skill, if the arc A were not present the diagonal dimension of the first tang 32 (not numbered) would prevent rotation of the first tang 32 to a position where the height H extended between the upper groove 10*a* and lower groove 10*b*, or between 22*a* and 22*b*, of the perimeter trim 10 or 22.

The example embodiment of FIGS. 5A–5C has a second arc B on the corner of the first tang 32 diagonally opposite from the corner having the radius A. The arc B is employed, and has a radius selected in accordance with the distance between grooves 10*a* and 10*b*, the radius A, and the width W1 to permit ready installation of the first tang 32 between the grooves.

As shown in FIGS. 5A–5C, the first tang 32 of the depicted example embodiment includes a first threaded through hole 34, extending normal to the first plane. Referring to FIG. 4, a screw (not shown) threads through the first threaded hole 34 of combination clip 30*a* and contacts the first perimeter trim 10, thereby locking the first tang 32 into engagement with the same. Similarly, a screw (not shown) threads through the first threaded hole 34 of second combination clip 30*b* and contacts the second perimeter trim 10, thereby locking the first tang 32 into engagement with the same.

The combination clip 30 shown by FIGS. 5A–5C further comprises a second tang 36 extending, in a second plane perpendicular to the first plane, a distance W2 from the right edge 32*d* of the first tang 32 in a first direction. The second tang 36 has a width W4. Referring to FIG. 5C, the first and second tang 32 and 36 have common cut-outs 50 and 52 which enable the first tang 32 to be rotated into a locking position with respect to groove pairs 10*a* and lob, and 22*a* and 22*b*.

The second tang 36 of the FIG. 5A–5C example has at least one through hole 38. One of through holes 38 is depicted as being elongated, to adjust for fitting variations.

The second tang 36 of FIGS. 5A–5C also has an extension 40, having a width W3, substantially centered with respect to the width W2 and projecting in a direction substantially parallel to a line within the first plane and perpendicular to the upper edge of the first tang. The extension projects a distance W5 relative to one of the reference lines of the major height H of the first tang 32.

Referring to FIG. 5B the example extension 40 has a proximal portion 40*a* extending in a first plane (not numbered) and a distal portion 40*b* extending in a second plane (not numbered). As shown in FIG. 5A the extension 40 has a distal portion 40*b* has a through-hole 42.

Referring to FIG. 4, a screw 18 of the first combination clip 32A passes through the through-hole 42 and through a corresponding through hole (not numbered) formed in the second T-grid frame 6. The multi-planar form of the extension 40 of FIGS. 5A–5C reflects an example for providing clearance and alignment with respect to the contact between the distal end 40*b* and the portion of the second T-grid frame it attaches to, as shown in FIG. 4. A nut (not shown) may thread onto a portion of the screw 18 which protrudes from the back side (not numbered) of the through-hole. Alternatively, the through-hole formed in the second T-grid frame may be threaded. The screw 18 is only an example means of attachment, as other methods known in the art of construction for attaching structural members may be used, such as rivets.

Table 1 below provides example dimensions of a combination clip according to FIGS. 5A–5C.

TABLE 1

| | |
|---|---|
| H | 1.50" |
| A | 0.63" |
| W1 | 0.80" |
| W2 | 1.75" |
| W3 | 0.50" |
| W4 | 1.00" |
| W5 | 2.69" |
| B | 0.25" |

Referring again to FIG. 4, a second combination clip 30B, identical in form and structure to the first combination clip 30A, connects an end portion 12 of the second T-grid frame 6 to a portion of the second perimeter trim 22. The upper and lower edges 32*a* and 32*b* of the first tang 32 of the second combination clip 30*b* are engaged, respectively, to an upper and lower groove 22*a* and 22*b* formed in the second perimeter trim 22. A screw 50 passes through the least one through hole 38 of the major portion of the second tang 36 of the second combination clip, and through a hole (not shown) located proximal to the end 12 of the second T-grid frame 6.

In the above-described arrangement the first combination clip 30A has a first orientation relative to the first and second T-grid frame 2 and 6 and the first and second perimeter trim 10 and 22, and the second combination clip 32B has a second orientation. With this arrangement and structure, the first tang 32 and the extension tang 40 of the first combination clip 30A connect a portion of the second T-grid frame to a portion of the first perimeter trim, while the first tang 32 and the major portion of the second tang 36 of the second combination clip 30B, which is identical to the first combination clip 30A, connect an end portion 12 of the second T-grid frame 6 to the second perimeter trim 22. Accordingly, the single combination clip of the present invention, by being rotated into different orientations, and by utilizing respective sub-portions of its tangs, accomplishes either of the two different connection functions which the prior art required a respective two different types of clips to accomplish.

It is to be understood that the present invention is described above in reference to specific embodiments, which are for purposes of example only, and that the invention is not limited to the specific arrangement, or configuration described hereinabove or shown in the drawings, but also comprises the various modifications readily apparent to one skilled in the art upon reading this specification, as defined by the broadest scope of the appended claims.

What is claimed is:

1. A suspended ceiling frame, comprising:

an upper frame;

means for suspending the upper frame from a room ceiling;

a lower frame having a rail extending in a first direction;

means for suspending the lower frame from the upper frame;

a first combination clip attached to an end portion of said rail, having a first plate, a second plate, and an extension protruding from the second plate, wherein the second plate extends in said first direction and faces against the end portion of said rail;

a first perimeter frame, extending perpendicular to said first direction, attached to the second plate of said first combination clip;

a second combination clip, identical in form and dimension to the first combination clip, having its extension attached to said rail; and a second perimeter frame attached to the first plate of the second combination clip.

2. A suspended ceiling frame according to claim 1, wherein said second perimeter frame has a first groove and a second groove parallel to the first groove, and wherein said first plate of the said first combination faces against a portion of said first perimeter frame and extends between and is at least partially constrained by said first groove and second groove.

3. A suspended ceiling frame according to claim 1, wherein said second perimeter frame has a first groove and a second groove parallel to the first groove, and wherein said first plate of the said second combination clip faces against a portion of said second perimeter frame and extends between and is at least partially constrained by said first groove and second groove.

4. A method for suspended a ceiling, comprising steps of:

suspending an upper frame from a room ceiling;

suspending a lower frame from the upper frame;

attaching a first perimeter frame to said lower frame by a first combination clip, said attaching including a step of orienting said first combination clip in a first manner for attaching to said first perimeter frame and said lower frame;

attaching a second perimeter frame to said lower frame by another combination clip identical in form and dimension to said first combination clip, said attaching including a step of orienting said another combination clip in a second manner, different from said first manner, for attaching to said second perimeter frame and said lower frame, wherein said first perimeter frame has a first and second groove spaced a first distance apart, and wherein said first combination clip has a first plate, a second plate, and an extension protruding from the second plate, said first plate having a length substantially equal to said first distance and a width substantially less than said first distance, and said step of attaching a first perimeter frame further comprises steps of:

placing said first plate against said first perimeter frame such that said width extends in the direction of said first distance;

rotating said first plate such that-said length extends between said first and second grooves in said first direction and is at least partially constrained by said first and second grooves; and securing said extension of said first combination clip to said lower frame.

5. A method for suspended a ceiling, comprising steps of:

suspending an upper frame from a room ceiling;

suspending a lower frame from the upper frame;

attaching a first perimeter frame to said lower frame by a first combination clip, said attaching including a step of orienting said first combination clip in a first manner for attaching to said first perimeter frame and said lower frame;

attaching a second perimeter frame to said lower frame by another combination clip identical in form and dimension to said first combination clip, said attaching including a step of orienting said another combination clip in a second manner, different from said first manner, for attaching to said second perimeter frame and said lower frame, wherein said second perimeter frame has a first and second groove spaced a first distance apart, and wherein said another combination clip has a first plate, a second plate, and an extension protruding from the second plate, said first plate having a length substantially equal to said first distance and a width substantially less than said first distance, and said step of attaching a second perimeter frame further comprises steps of:

placing said first plate against said second perimeter frame such that said width extends in the direction of said first distance;

rotating said first plate such that said length extends between said first and second grooves in said first direction and is at least partially constrained by said first and second grooves; and securing said second plate of said another combination clip to said lower frame.

6. A method according to claim 4 wherein said second perimeter frame has a first and second groove spaced said first distance apart, and wherein said another combination clip has a first plate, a second plate, and an extension protruding from the second plate, said first plate having a length substantially equal to said first distance and a width substantially less than said first distance, and said step of attaching a second perimeter frame further comprises steps of:

placing said first plate against said second perimeter frame such that said width extends in the direction of said first distance;

rotating said first plate such that said length extends between said first and second grooves in said first direction and is at least partially constrained by said first and second grooves; and securing said second plate of said another combination clip to said lower frame.

* * * * *